US007268614B2

(12) United States Patent
Jung

(10) Patent No.: US 7,268,614 B2
(45) Date of Patent: Sep. 11, 2007

(54) LOW SUPPLY VOLTAGE BIAS CIRCUIT, SEMICONDUCTOR DEVICE, WAFER AND SYSTEM INCLUDING SAME, AND METHOD OF GENERATING A BIAS REFERENCE

(75) Inventor: Chul Min Jung, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/411,286

(22) Filed: Apr. 25, 2006

(65) Prior Publication Data

US 2006/0186950 A1 Aug. 24, 2006

Related U.S. Application Data

(63) Continuation of application No. 10/841,848, filed on May 7, 2004, now Pat. No. 7,071,770.

(51) Int. Cl.
*G05F 1/10* (2006.01)

(52) U.S. Cl. ..... 327/543

(58) Field of Classification Search ..... 323/312, 323/313, 314, 315, 316; 327/534, 535, 537, 327/538, 539, 540, 541, 543
See application file for complete search history.

(56) References Cited

U.S. PATENT DOCUMENTS 4,472,675 A 9/1984 Shinomiya
5,216,291 A 6/1993 Seevinck et al.
5,341,047 A 8/1994 Rosenthal
5,394,026 A 2/1995 Yu et al.
5,532,578 A 7/1996 Lee
5,532,579 A 7/1996 Park
5,818,212 A 10/1998 Min et al.
5,825,236 A 10/1998 Seevinck et al.
5,945,821 A 8/1999 Sakurai et al.
6,037,762 A 3/2000 Koelling et al.
6,037,833 A 3/2000 Ang
6,046,944 A 4/2000 Singh
6,127,881 A 10/2000 Tsay et al.
6,194,887 B1 2/2001 Tsukada
6,281,743 B1 8/2001 Doyle
6,310,511 B1 10/2001 Weinfurtner
6,320,364 B1 11/2001 Tateishi et al.
6,433,624 B1 8/2002 Grossnickle et al.
6,489,836 B2 12/2002 Yeong
6,630,859 B1 10/2003 Wang
6,642,778 B2 11/2003 Opris

*Primary Examiner*—Jeffrey Zweizig
(74) *Attorney, Agent, or Firm*—TraskBritt

(57) ABSTRACT

A bias generator and a method of generating a bias reference are disclosed. A reference transistor is connected in a diode configuration. An n-channel transistor connects in series with the reference transistor. A resulting reference current through the two transistors is controlled by the gate voltage on the n-channel transistor. A p-channel transistor configured as a first current mirror of the reference transistor generates a mirrored current. A voltage is developed across an impedance element connected in the path of the mirrored current. A feedback buffer connects between the voltage and the gate of the n-channel transistor to close a feedback loop stabilizing at a point where the reference current and mirrored current are proportional. A second current mirror supplies an output current. An optional n-channel transistor, configured in series with the second current mirror, may generate an output voltage proportional to the output current.

23 Claims, 5 Drawing Sheets

LOW SUPPLY VOLTAGE BIAS CIRCUIT, SEMICONDUCTOR DEVICE, WAFER AND SYSTEM INCLUDING SAME, AND METHOD OF GENERATING A BIAS REFERENCE

CROSS-REFERENCE TO RELATED APPLICATION

This application is a continuation of application Ser. No. 10/841,848 filed May 7, 2004, now U.S. Pat. No. 7,071,770, issued Jul. 4, 2006.

BACKGROUND OF THE INVENTION

1. Field of the Invention

The present invention relates to bias circuits for generating bias voltages and currents. More specifically, the present invention relates to the generation of low voltages using a low supply voltage.

2. Description of Related Art

Many systems that manipulate and generate analog and digital signals need precise, stable voltage and current references defining bias points for these signals. In many cases, these voltage references must be in addition to and independent of a supply voltage for the circuit. In Dynamic Random Access Memories (DRAM), as well as other semiconductor devices, some of these applications are in areas such as, sense amplifiers, input signal level sensors, phase locked loops, delay locked loops, and various other analog circuits.

Various techniques exist for generating these supply voltages. Traditional bias generation techniques vary from a simple resistor voltage divider to complex bandgap reference circuits. These reference voltages may typically need to be independent from a source supply voltage. Unfortunately, as supply voltages become lower in modern low power and deep submicron designs, bias generating techniques become more difficult. Many traditional techniques require a supply voltage significantly higher than the desired reference voltage and do not scale proportionally as the supply voltage decreases.

A voltage reference may be created from a traditional and simple voltage divider circuit using resistors in series or diode-connected metal-oxide semiconductor (MOS) transistors in series. Unfortunately, the resultant reference voltage is a function of the supply voltage and controlling the resistance precision of the resistors or transistors may be difficult. Voltage dividers are, therefore, not an adequate solution when supply independence is required.

Bandgap reference sources are quite flexible and may generate supply independent reference voltages, sometimes even with a relatively low supply voltage. However, bandgap reference circuits tend to be complex requiring complicated analog amplifier feedback, significant area on a semiconductor die, and relatively high operating currents. As a result, bandgap references have significant disadvantages in low power applications.

Complementary MOS (CMOS) circuits are often used to generate supply independent reference voltages using transistor threshold voltages (Vt) to generate a reference. These circuits typically have the advantage of being small in area, relatively simple, and relatively independent from the supply voltage. However, Vt referenced bias sources typically require a relatively high supply voltage to generate the reference voltage. FIG. 1 illustrates a conventional Vt referenced bias circuit.

The FIG. 1 circuit, as well as the present invention, contains two well-known circuit configurations known as diode-connected transistors and current mirrors.

A diode-connected transistor is formed when the gate and drain of the transistor are connected together. For example, in the bias circuit shown in FIG. 1, the p-channel transistor P11 is connected in a diode configuration. The P11 transistor operates in the saturation region because the gate and drain are connected to the same potential. As a result, the transistor operates with voltage to current properties similar to a p-n junction diode.

A current mirror is a configuration comprising two transistors of the same type (e.g., both p-channels or both n-channels) in which the sources of the transistors are connected together and the gates of the transistors are connected together. Current mirrors operate on the theory that if the two transistors are similarly processed and have sizes W/L (i.e., width/length) in a defined proportion N, then the current relationship through the two transistors will have the same proportion N. For example, in bias circuit 10 shown in FIG. 1, if the reference transistor P11 and the first current mirror P12 have the same W/L, they will have substantially the same amount of current flowing through them. This is so because both transistors are connected to the same source, and have the same gate-to-source voltage, which defines the magnitude of the drain current. Typically, current mirrors are designed with the two transistors having the same size (i.e., the proportion N=1). However, other proportions may be used.

Referring to the bias circuit 10 in FIG. 1, the current mirror configuration of p-channel transistor P11 and first current mirror P12 causes the currents I11 and I12 through P11 and P12, respectively, to be proportional to each other. In most applications, P11 and P12 are the same size resulting in substantially the same currents for I11 and I12. The I11 current flowing through p-channel P11 also flows through n-channel transistor N11. For current to flow through N11, the gate-to-source voltage on N11 must be at or above a threshold voltage. This gate voltage is supplied by the voltage drop across resistor R12. However, the n-channel transistor N12 in series with R12 regulates the amount of current flowing through R12. For current to flow in N12, the gate-to-source voltage of N12 must also be at or above a threshold voltage. However, the source of N12 is already at least a threshold voltage above ground due to the voltage drop through R12. Therefore, the gate voltage of N12 must be at least two threshold voltages above ground for N12 to conduct. This stacked configuration of R12, N11, and N12, creates a feedback loop wherein increased current through N12 raises the gate voltage on N11, increasing the current through N11. However, increased current through N11 reduces the gate voltage on N12, thereby reducing the current through N12. The feedback loop reaches an equilibrium defining the amount of current flowing through N11 and, as a result, P11. This feedback configuration is often termed a "cascade" arrangement due to the stacked nature of the n-channel transistors. Unfortunately, the cascade arrangement increases the required supply voltage.

The lowest possible supply voltage is equal to the sum of the threshold voltages of N11, N12, and P11. In the FIG. 1 bias circuit 10, a third p-channel transistor P13 is typically configured as another current mirror to generate a stable buffered current I13 through P13, which is proportional to the current through P11.

Because the FIG. 1 bias circuit 10 generates a reference voltage across multiple stacked gate-to-source voltage drops, it requires the supply voltage to be higher than the gate-to-gate source voltage of the stacked transistors. As a result, the circuit in FIG. 1 is not suitable for low supply voltage applications.

There is a need for a simple Vt threshold referenced bias circuit for generating low reference voltages in a system using a low supply voltage.

BRIEF SUMMARY OF THE INVENTION

One embodiment of the present invention comprises a bias generator comprising a number of CMOS circuit components. A first p-channel transistor (also referred to as a reference transistor) is connected in a diode configuration. A first n-channel transistor (also referred to as a current sink transistor) connects in series with the reference transistor. As a result, the gate voltage on the first n-channel transistor controls a reference current through the first p-channel transistor and the first n-channel resistor. A second p-channel transistor configured as a first current mirror of the first p-channel transistor mirrors current flowing through the second p-channel transistor. The mirrored current flowing through the second p-channel transistor will be proportional to the reference current flowing through the first p-channel transistor. An impedance element connected in series with the second p-channel transistor develops a second voltage across the impedance element proportional to the current through the impedance element and the second p-channel transistor. A cascade feedback buffer's input connects to the second voltage, and its output connects to the gate of the first n-channel transistor. The cascade feedback buffer closes a feedback loop wherein the bias generator stabilizes to a point where the reference current and mirrored current are proportional to each other having the same proportion as the reference transistor size to the second p-channel transistor size. A third p-channel transistor configured as a second current mirror supplies an output current for use by other circuitry (not shown). A third n-channel transistor may be optionally configured in series with the second current mirror for generating a reference output voltage proportional to the output current.

Another embodiment of the present invention comprises a method of generating a bias reference. The method comprises providing a supply voltage level of at least one transistor threshold voltage plus one transistor saturation voltage. A reference current may be generated from the supply voltage as a function of a feedback voltage. The reference current may be mirrored to a proportional mirrored current generated from the supply voltage. A first voltage may be generated as a function of the mirrored current by creating a voltage drop across an impedance element configured in the path of the mirrored current. The feedback voltage may be modified in proportion to the first voltage by a cascade feedback buffer. The resultant feedback voltage may modify the reference current and, as a result, the mirrored current until the reference current and mirrored current reach stable and proportional levels. Additionally, the reference current may be mirrored to an output current generated from the supply voltage. Finally, a reference output voltage may be generated as a function of the output current by creating a voltage drop across a second impedance element configured in the path of the output current.

Another embodiment of the present invention includes at least one bias generator according to the invention described herein on a semiconductor device.

Another embodiment of the present invention includes a plurality of semiconductor devices incorporating at least one bias generator according to the invention described herein fabricated on a semiconductor wafer.

Yet another embodiment, in accordance with the present invention comprises an electronic system comprising an input device, an output device, a processor, and a memory device. The memory device comprises at least one semiconductor memory incorporating the bias generator described herein.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

In the following description, for the most part, details concerning timing considerations and the like have been omitted inasmuch as such details are not necessary to obtain a complete understanding of the present invention and are within the ability of persons of ordinary skill in the relevant art.

Figure 1:
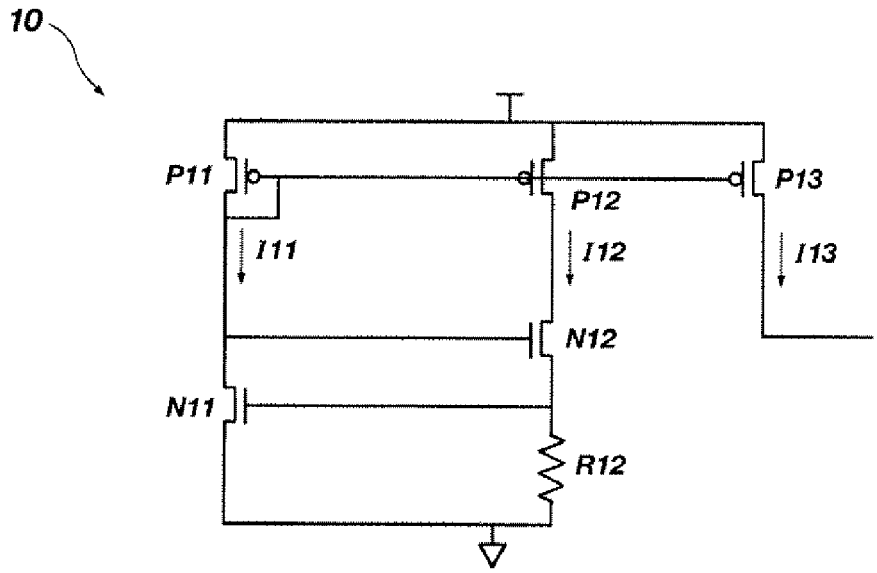
FIG. 1 (PRIOR ART)
FIG. 1 is a circuit diagram of a conventional bias circuit.
Figure 2:
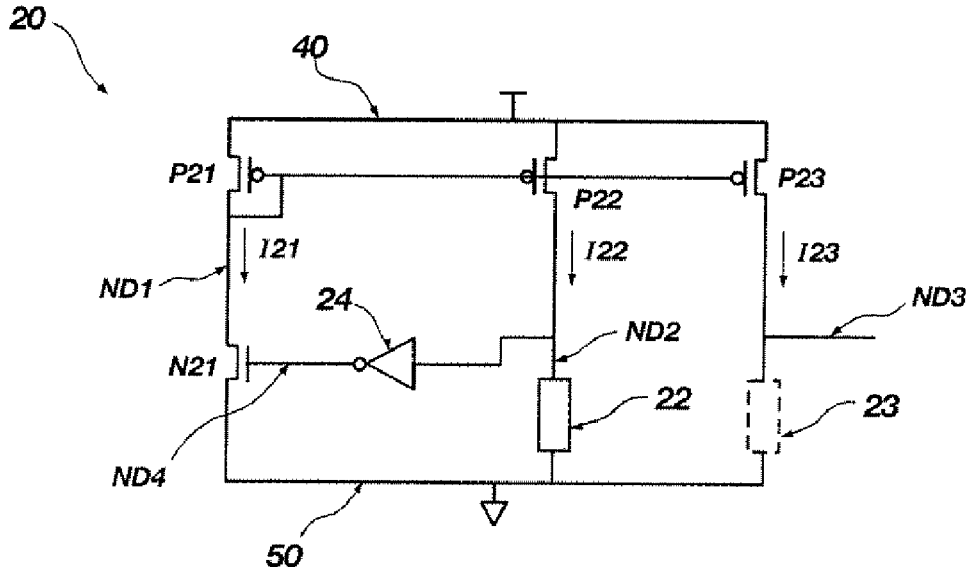
FIG. 2 depicts an exemplary bias circuit according to the present invention.

FIG. 2 shows a reference bias generator 20 according to the present invention. A reference transistor P21, also referred to as a first p-channel transistor P21, is shown connected in a diode configuration wherein the gate and drain are connected together. The source of the reference transistor P21 connects to a supply voltage 40 (also referred to as Vcc), and the gate and drain of the reference transistor P21 are connected together at node ND1. A first current mirror P22, also referred to as second p-channel transistor P22, connects through its source to the supply voltage 40, and connects through its gate to the gate of the reference transistor P21 at node ND1. A second current mirror P23, also referred to as a third p-channel transistor P23, connects through its source to the supply voltage 40 and connects through its gate to the reference transistor's P21 gate at node ND1. The drain of the second current mirror P23 forms an output current I23 for utilization by other circuitry (not shown) at node ND3. The exemplary embodiment shown in FIG. 2 shows the reference transistor P21 connected in a diode configuration and the first current mirror P22 configured to proportionally mirror the current through the reference transistor. However, this configuration may be reversed. In other words, the first current mirror P22 may be connected in a diode configuration and the reference transistor P21 configured to proportionally mirror the current through the first current mirror P22. In addition, as stated earlier, current mirrors are typically designed with the two transistors having the same size (i.e., the proportion N=1). However, other proportions are contemplated within the scope of the invention. Particularly, proportions with N as integer multiples, such as, for example, 2, 3 and 4 are used in many current mirror applications and are within the scope of the present invention.

Also in the FIG. 2 embodiment, a current sink transistor N21 connects in series with the reference transistor P21, such that the source of the current sink transistor N21 connects to a ground voltage 50 (also referred to as Vss), the gate of the current sink transistor N21 connects to an output from a cascade feedback buffer 24, and the drain of the current sink transistor N21 connects to the drain of the reference transistor P21 at node ND1. An impedance element 22 connects in series with the first current mirror P22 such that one terminal connects to the ground voltage 50 and the other terminal connects to the drain of the first current mirror P22 at node ND2. An optional second impedance element 23 (shown with a broken line) connects in series with the second current mirror P23 such that one terminal connects to the ground voltage 50 and the other terminal connects to the drain of the second current mirror P23.

The cascade feedback buffer 24 creates a feedback loop by connection of the cascade feedback buffer's 24 input to the drain of the first current mirror P22 at node ND1 and the cascade feedback buffer's 24 output to the gate of the current sink transistor N21 at node ND4.

Figure 3:
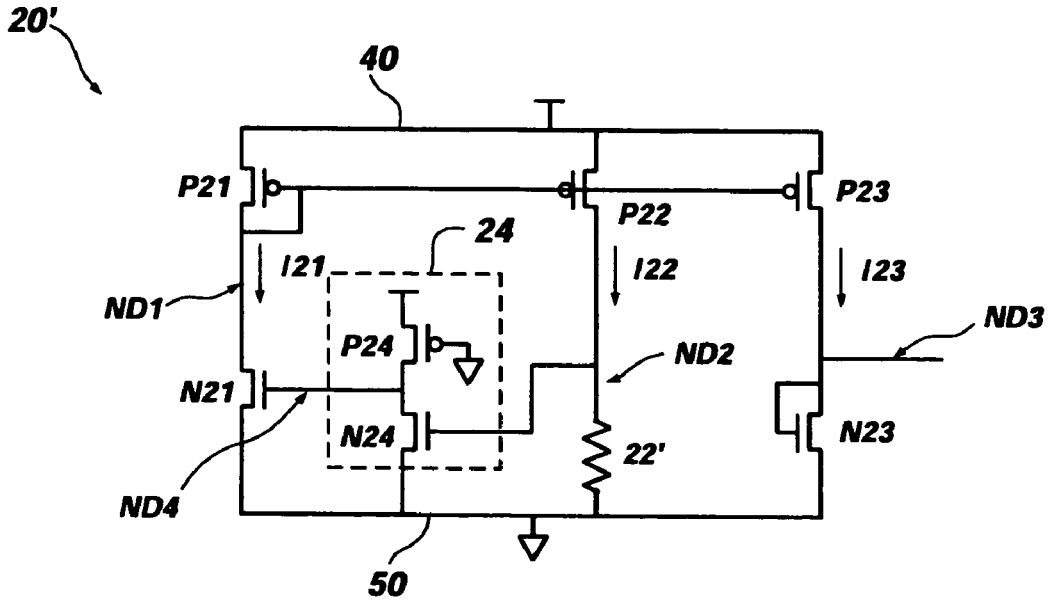
FIG. 3 depicts another exemplary bias circuit according to the present invention.

FIG. 3 shows another exemplary embodiment of a bias generator 20'. In FIG. 3, the cascade feedback buffer 24 is shown as a buffer current source P24 in series with a fourth n-channel transistor N24. The buffer current source P24 is configured as a fourth p-channel transistor P24 configured to be always conducting by connecting its source to the supply voltage 40 and its gate to the ground voltage 50. The drain of the fourth p-channel transistor P24 connects to the drain of the fourth n-channel transistor N24 forming the output of the cascade feedback buffer at node ND4. The gate of the fourth n-channel transistor N24 forms the input of the cascade feedback buffer 24 and connects to node ND2. The source of the fourth n-channel transistor N24 connects to the ground voltage 50. The buffer current source P24 may be formed by other means. For example, a relatively high impedance resistor (not shown) may be used to ensure that the current through the resistor remains small to reduce overall power consumption. Reasons for selecting various types of buffer current sources P24 are explained below in the section dealing with operation of the bias generator 20'.

Additionally, FIG. 3 shows the impedance element 22' as a resistor. The impedance element 22' may also be formed using various circuit elements and connections to generate a relatively constant resistance value. Some possible resistor implementations include, for example, using a length of N+ doped region as a resistor element, using a length of polysilicon as a resistor element, and connecting an n-channel transistor such that it operates in the saturation region.

Finally, FIG. 3 shows the second impedance element 23 as a third n-channel transistor N23 in a diode-connected configuration and connected in series with the second current mirror P23. The source of the third n-channel transistor N23 connects to the ground voltage 50. The gate and drain of the third n-channel transistor N23 connect to the drain of the second current mirror P23 at node ND3. This third n-channel transistor N23 in the path of the output current I23 through the second current mirror P23 creates a reference output voltage 33 proportional to the second current for utilization by other circuitry (not shown) at node ND3. As with the impedance element 22', the second impedance element N23 may be formed using various circuit elements and connections to generate a relatively constant resistance value. Some possible resistor implementations include, for example, using a length of N+ doped region as a resistor element, using a length of polysilicon as a resistor element, and connecting an n-channel transistor such that it operates in the saturation region as shown in FIG. 3.

Figure 5:
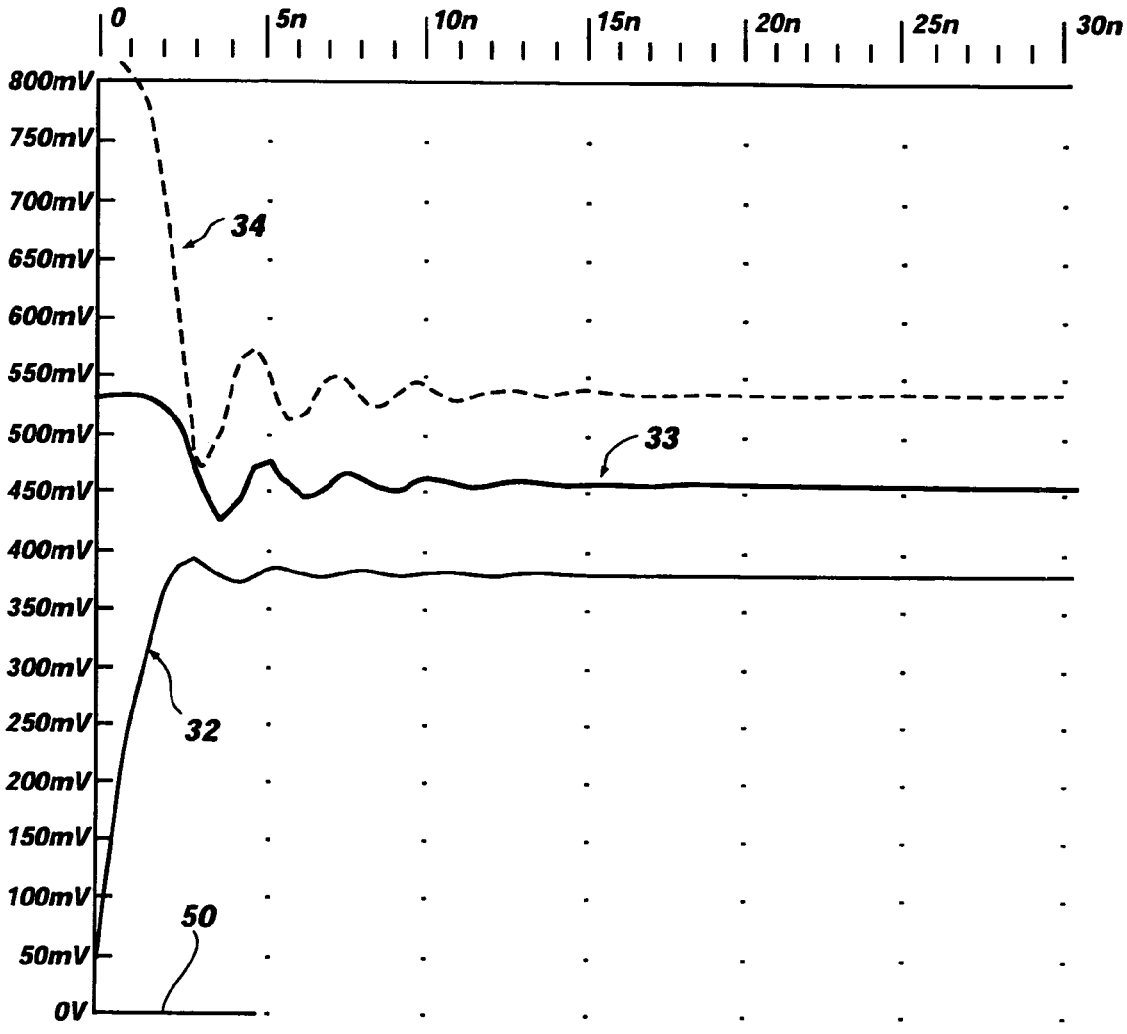
FIG. 5 is a graph of AC simulation results showing the settling time and voltage characteristics of a reference voltage and voltages on other intermediate nodes.

In operation, referring to FIGS. 3 and 5, assume node ND2 starts out at a potential equal to the ground voltage 50. The fourth n-channel transistor N24 in the cascade feedback buffer 24 is off and the fourth p-channel transistor P24 will generate a high at node ND2 because it is configured to be in a conducting state. The high at node ND2 causes the current sink transistor N21 to conduct, generating a reference current I21 through the reference transistor P21 and current sink transistor N21. This reference current I21 is mirrored to a mirrored current I22 flowing through the first current mirror P22 as a result of the current mirror configuration between the reference transistor P21 and the first current mirror P22. If the reference transistor P21 and the first current mirror P22 are substantially the same size, the reference current I21 and mirrored current I22 may be substantially equal. The mirrored current I22 flows through the impedance element 22'. A first voltage 32 at node ND2 moves up to a voltage equal to the voltage drop across the impedance element 22', represented as the mirrored current I22 multiplied by the resistance (R) of the impedance element 22' (i.e., I22*R).

The rise in the first voltage 32 at ND2 causes the fourth n-channel transistor N24 to begin sinking current once the first voltage 32 reaches or goes above the threshold voltage of the fourth n-channel transistor N24. The current flowing through the fourth p-channel transistor P24 and fourth n-channel transistor N24 causes the feedback voltage at node ND4 to go to an intermediate level between the supply voltage 40 and the ground voltage 50. This intermediate level on the gate of the current sink transistor N21 reduces the drain current through the current sink transistor N21 and, as a result, the drain current through the reference transistor P21 (i.e., the reference current I21). The reduced reference current I21 mirrors on to the mirrored current I22 through the first current mirror P22. The reduced second current mirror P23 causes the voltage drop across the impedance element 22' (i.e., the first voltage 32) to fall. The falling first voltage 32 reduces the drain current through the fourth n-channel transistor N24, completing the self-biasing feedback loop. Because of the self-biasing feedback loop, the bias generator 20' will settle at a first voltage 32 substantially near the threshold voltage of the fourth n-channel transistor N24 (Vt). As a result, the mirrored current I22 will substantially equal Vt/R. If the first current mirror P22 and reference transistor P21 are substantially the same size, the reference current I21 will substantially equal the mirrored current I22. Finally, if the second current mirror P23 and first current mirror P22 are substantially equal, the output current I23 will substantially equal the mirrored current I22 (i.e., Vt/R).

The cascade feedback buffer 24 in the exemplary embodiment shown in FIG. 3 is implemented with the fourth p-channel transistor P24 configured to always conduct. In operation, the self-biasing feedback circuit may actually have two stable operating points. Implementing the cascade feedback buffer 24 as a simple CMOS inverter may allow node ND4 to startup at the ground voltage 50. In this case, no reference current I21 will flow through the current sink transistor N21. With no reference current I21 flowing through the current sink transistor N21 or, as a result, through the reference transistor P21, no mirrored current I22 will flow through the first current mirror P22. The bias generator 20' becomes locked at a point with no reference current I21 or mirrored current I22. By implementing a buffer current source P24 supplying a relatively constant current from the supply voltage 40, the bias circuit will start up in a state allowing reference current I21 and mirrored current I22 to flow. On the other hand, the buffer current source P24 may be very weak. Once the bias generator 20' starts, the feedback is controlled primarily through the feedback n-channel transistor N24. As a result, when the buffer current source P24 is implemented with a transistor, the buffer current source P24 transistor may be substantially smaller than the feedback n-channel transistor N24. Similarly, if the buffer current source P24 is implemented as a resistor, the resistor may have a relatively high resistance. Using a high resistance for the buffer current source reduces power consumption without unduly influencing bias generator 20' operation.

Figure 4:
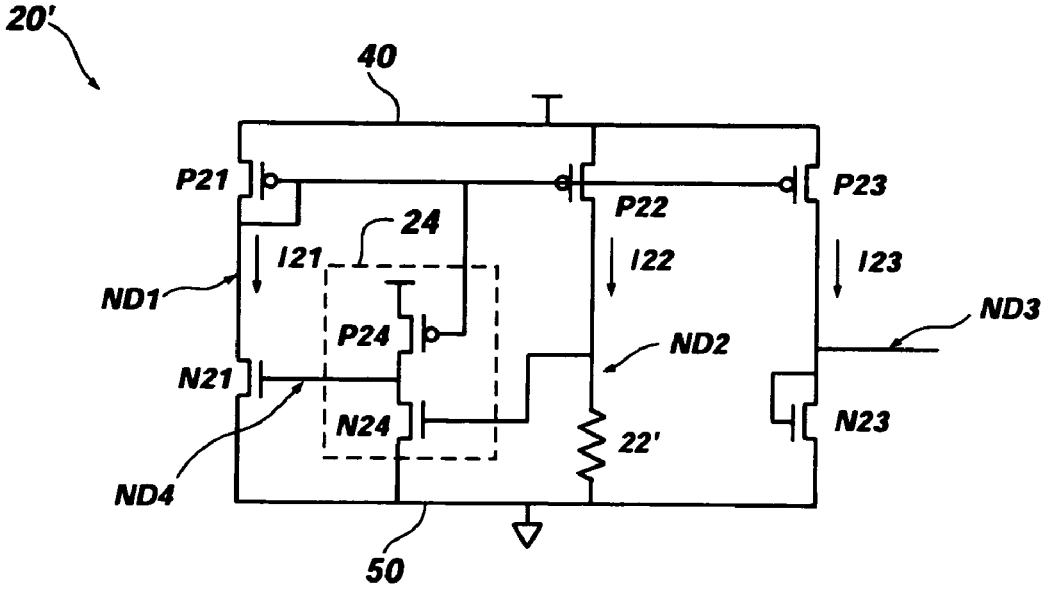
FIG. 4 depicts yet another exemplary bias circuit according to the present invention.

FIG. 4 depicts the present invention with another exemplary embodiment of the cascade feedback buffer 24. In the FIG. 4, embodiment, the gate of the fourth p-channel transistor P24 is connected to node ND1, rather than ground. This embodiment still ensures that the self-biasing feedback circuit starts up in the state allowing the flow of reference current I21 and mirrored current I22. Additionally, this embodiment may reduce power consumption and power variation because the buffer current source P24 may conduct a smaller current to the higher gate voltage on the fourth p-channel transistor P24.

Finally, if a reference output voltage 33 is desired, the third n-channel transistor N23 in a diode-connected configuration may be added in series with the second current mirror P23, generating the reference output voltage 33 substantially equal to the voltage drop across the third n-channel transistor N23.

As may be seen, the final current at which the bias generator 20' settles is dependent upon the resistance of the impedance element 22'. This element may be chosen to generate a desired current level. However, to ensure that the fourth n-channel transistor N24 operates in the saturation mode, the resistance should be chosen, in conjunction with the size of the second current mirror P23, to be at least high enough to generate a voltage drop of at least the threshold voltage of the fourth n-channel transistor N24.

FIG. 5 is an AC simulation graph of the start up conditions for the exemplary embodiment of the invention shown in FIG. 3. The simulation graph shows the feedback response and stabilization described above. As described above, the simulation graph shows the first voltage 32 beginning near the ground voltage 50 and rising as a response to the mirrored current I22 flowing through the impedance element 22'. The feedback voltage 34, as an output of the cascade feedback buffer 24, is shown beginning near the supply voltage 40 (not shown) and dropping in response to the rising first voltage 32. The reference output voltage 33 is also shown. As may be seen from the graph, the bias generator 20' (not shown in FIG. 5) possesses a fast settling time, settling to a stable voltage in less than 15 nanoseconds.

Figure 6:
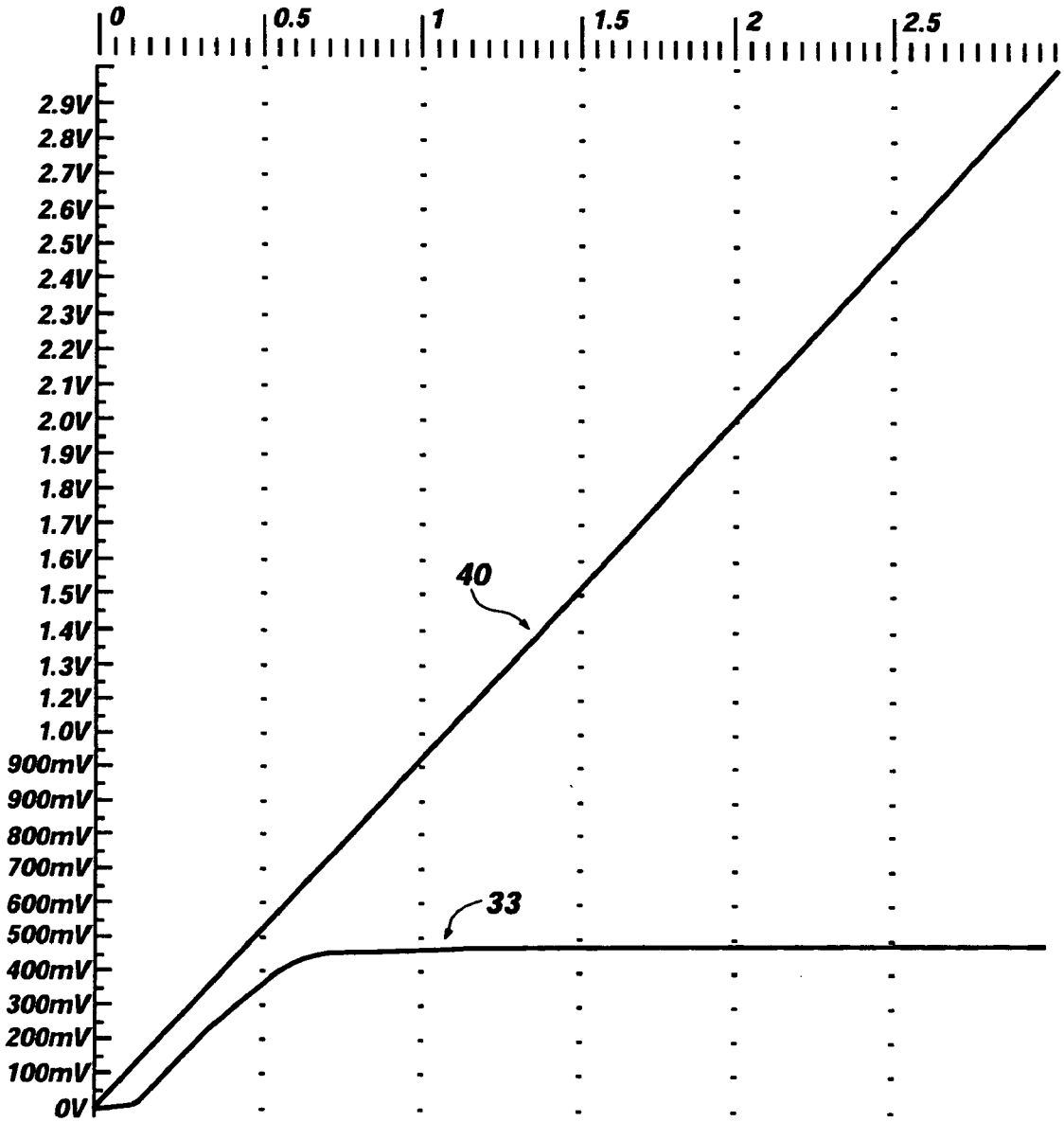
FIG. 6 is a graph of DC simulation results depicting the reference voltage at various Vcc supply voltages.

The theoretical minimum supply voltage 40 at which the bias generator 20' may operate is defined as the threshold voltage (Vt) of the fourth n-channel transistor N24 plus the saturation voltage of the first current mirror P22. This supply voltage 40 is significantly lower than the three threshold voltages required in the prior art. For an exemplary process, the threshold voltage of the fourth n-channel transistor N24 plus the saturation voltage of the second current mirror P23 may be approximately 0.5 volts. Therefore, the supply voltage 40 for the exemplary process may be theoretically as low as about 0.5 volts. In practice, the supply voltage 40 may need to be slightly higher, such that the fourth n-channel transistor N24 is operating slightly above its threshold voltage. FIG. 6 depicts a DC simulation of the generated reference output voltage 33 in relation to various Vcc supply voltages 40. In this exemplary process, the reference output voltage 33 flattens at the point where the supply voltage 40 has risen to a point where the bias generator 20' begins stable operation. As shown in FIG. 5, the reference voltage flattens at a supply voltage 40 of about 0.65 volts for the simulated exemplary embodiment.

It will be clear to a person of ordinary skill in the art that a bias generator creating a current sink reference or a voltage reference relative to the supply voltage may be obtained by inverting the circuit. In other words, replacing p-channel transistors with n-channel transistors and vice versa, with the supply voltage and ground voltage connections also reversed.

As mentioned earlier, embodiments of the present invention, while mostly described in relation to semiconductor memories, are applicable to many semiconductor devices. By way of example, any semiconductor device requiring a bias voltage or bias current source for applications such as sense amplifiers, input signal level sensors, phase locked loops, and delay locked loops, may use the present invention.

Figure 7:
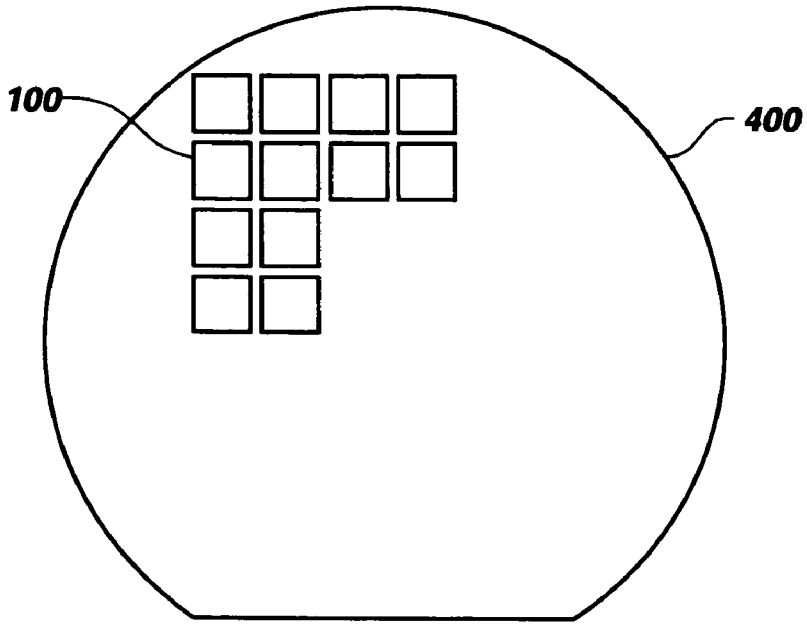
FIG. 7 is a semiconductor wafer containing a plurality of semiconductor devices containing a bias circuit according to the present invention.

As shown in FIG. 7, a semiconductor wafer 400, in accordance with the present invention, includes a plurality of semiconductor devices 100 incorporating the bias generator 20 (not shown) described herein. Of course, it should be understood that the semiconductor devices 100 may be fabricated on substrates other than a silicon wafer, such as, for example, a Silicon On Insulator (SOI) substrate, a Silicon On Glass (SOG) substrate, and a Silicon On Sapphire (SOS) substrate.

Figure 8:
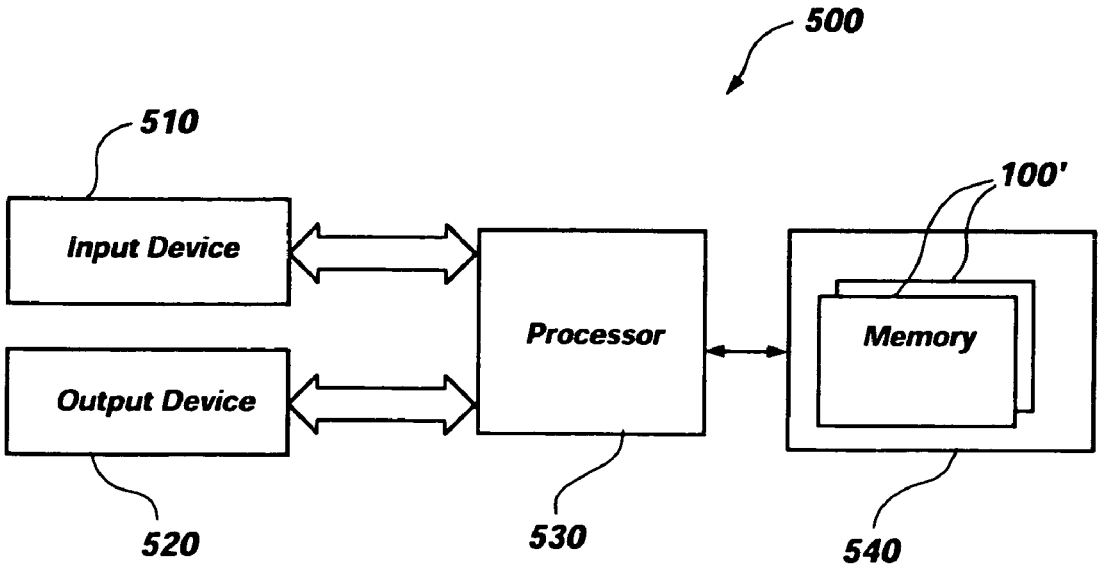
FIG. 8 is a computing system diagram showing a plurality of semiconductor memories containing a bias circuit according to the present invention.

As shown in FIG. 8, an electronic system 500, in accordance with the present invention, comprises an input device 510, an output device 520, a processor 530, and a memory device 540. The memory device 540 comprises at least one semiconductor memory 100' incorporating the bias generator 20 described herein in a DRAM device. It should be understood that the semiconductor memory 100' might comprise a wide variety of devices other than a DRAM, including, for example, Static RAM (SRAM) devices, and Flash memory devices.

Although this invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A bias generator, comprising:

a reference transistor connected in a diode configuration;

a current sink transistor in a path of the reference transistor configured to generate a reference current;

a first current mirror configured to generate a mirrored current as a function of the reference current;

an impedance element in a path of the first current mirror configured to generate a first voltage in proportion to the mirrored current;

a cascade feedback buffer with an input operably coupled to the first voltage and an output operably coupled to a gate of the current sink transistor, the cascade feedback buffer comprising:

a p-channel transistor having a first terminal operably coupled to a supply voltage, a second terminal operably coupled to the output of the cascade feedback buffer, and a gate connected to a ground voltage; and a buffer current sink comprising an n-channel transistor having a source coupled to the ground voltage, a gate coupled to the input of the cascade feedback buffer, and a drain coupled to the second terminal of the p-channel transistor; and a second current mirror configured to generate an output current as a function of the reference current.

2. The bias generator of claim 1, further comprising a second impedance element in the path of the second current mirror configured to generate a reference output voltage.

3. The bias generator of claim 1, wherein the impedance element is coupled between the ground voltage and the first current mirror, and wherein the impedance element is selected from the group consisting of a diode-connected n-channel transistor, a polysilicon resistor, and an N+ resistor.

4. The bias generator of claim 1, wherein a resistance of the impedance element is sufficient to generate the first voltage of at least one n-channel transistor threshold voltage.

5. The bias generator of claim 1, wherein the reference transistor comprises a p-channel transistor.

6. The bias generator of claim 5, wherein the first current mirror comprises a second p-channel transistor having a size relative to a size of the reference transistor defining a proportion N, such that the mirrored current has the proportion N relative to the reference current.

7. The bias generator of claim 6, wherein the proportion N is substantially equal to one.

8. The bias generator of claim 5, wherein the second current mirror comprises a second p-channel transistor having a size relative to a size of the reference transistor defining a proportion M, such that the mirrored current has the proportion M relative to the reference current.

9. The bias generator of claim 8, wherein the proportion M is substantially equal to one.

10. A method of generating a bias reference, comprising:

providing a supply voltage level of at least one transistor threshold voltage plus one transistor saturation voltage;

generating a reference current from the supply voltage as a function of a feedback voltage;

mirroring the reference current to a mirrored current generated from the supply voltage;

generating a first voltage as a function of the mirrored current;

modifying the feedback voltage in proportion to the first voltage with a cascade feedback buffer configured as a p-channel transistor with its gate connected to a around voltage and connected in series between a supply voltage and a fourth n-channel transistor, such that the cascade feedback buffer generates the feedback voltage in proportion to the first voltage and wherein the feedback voltage modifies the reference current and the mirrored current to stable values; and mirroring the reference current to an output current generated from the supply voltage.

11. The method of claim 10, wherein generating the reference current is performed by a diode-connected first p-channel transistor configured in series with a first n-channel transistor.

12. The method of claim 10, wherein mirroring the reference current to the mirrored current is performed by a second p-channel transistor configured as a current mirror relative to the reference current.

13. The method of claim 10, wherein generating the first voltage is performed by an impedance element configured in the path of the mirrored current resulting in the first voltage being proportional to the mirrored current multiplied by a resistance value of the impedance element.

14. The method of claim 13, wherein the resistance value is selected such that the first voltage is at least a threshold voltage of an n-channel transistor.

15. The method of claim 10, wherein mirroring the reference current to the output current is performed by a third p-channel transistor configured as a current mirror relative to the reference current.

16. The method of claim 10, further comprising:

generating a reference output voltage proportional to the output current.

17. The method of claim 16, wherein generating the reference output voltage is performed by a second impedance element configured in the path of the output current.

18. A semiconductor device including at least one bias generator, comprising:

a reference transistor connected in a diode configuration;

a current sink transistor in a path of the reference transistor configured to generate a reference current;

a first current mirror configured to generate a mirrored current as a function of the reference current;

an impedance element in a path of the first current mirror configured to generate a first voltage in proportion to the mirrored current;

a cascade feedback buffer with an input operably coupled to the first voltage and an output operably coupled to a gate of the current sink transistor, the cascade feedback buffer comprising:

a p-channel transistor having a first terminal operably coupled to a supply voltage, a second terminal operably coupled to the output of the cascade feedback buffer, and a gate connected to a ground voltage; and a buffer current sink comprising an n-channel transistor having a source coupled to the ground voltage, a gate coupled to the input of the cascade feedback buffer, and a drain coupled to the second terminal of the p-channel transistor; and a second current mirror configured to generate an output current as a function of the reference current.

19. The semiconductor device of claim 18, further comprising a second impedance element in the path of the second current mirror configured to generate a reference output voltage.

20. A semiconductor wafer, comprising:

at least one semiconductor device including at least one bias generator, comprising:

a reference transistor connected in a diode configuration;

a current sink transistor in a path of the reference transistor configured to generate a reference current;

a first current mirror configured to generate a mirrored current as a function of the reference current;

an impedance element in a path of the first current mirror configured to generate a first voltage in proportion to the mirrored current;

a cascade feedback buffer with an input operably coupled to the first voltage and an output operably coupled to a gate of the current sink transistor, the cascade feedback buffer comprising:

a p-channel transistor having a first terminal operably coupled to a supply voltage, a second terminal operably coupled to the output of the cascade feedback buffer, and a gate connected to a ground voltage; and a buffer current sink comprising an n-channel transistor having a source coupled to the ground voltage, a gate coupled to the input of the cascade feedback buffer, and a drain coupled to the second terminal of the p-channel transistor; and a second current mirror configured to generate an output current as a function of the reference current.

21. The semiconductor wafer of claim 20, further comprising a second impedance element in a path of the second current mirror configured to generate a reference output voltage.

22. An electronic system, comprising:

at least one input device;

at least one output device;

a processor; and a memory device comprising, at least one semiconductor memory, including at least one bias generator, comprising:

a reference transistor connected in a diode configuration;

a current sink transistor in a path of the reference transistor configured to generate a reference current;

a first current mirror configured to generate a mirrored current as a function of the reference current;

an impedance element in a path of the first current mirror configured to generate a first voltage in proportion to the mirrored current;

a cascade feedback buffer with an input operably coupled to the first voltage and an output operably coupled to a gate of the current sink transistor, the cascade feedback buffer comprising:

a p-channel transistor having a first terminal operably coupled to a supply voltage, a second terminal operably coupled to the output of the cascade feedback buffer, and a gate connected to a ground voltage; and a buffer current sink comprising an n-channel transistor having a source coupled to the ground voltage, a gate coupled to the input of the cascade feedback buffer, and a drain coupled to the second terminal of the p-channel transistor; and a second current mirror configured to generate an output current as a function of the reference current.

23. The electronic system of claim 22, further comprising a second impedance element in a path of the second current mirror configured to generate a reference output voltage.

* * * * *